United States Patent [19]

Baumgartner et al.

[11] 4,445,475

[45] May 1, 1984

[54] ENGINE IDLING SPEED CONTROL SYSTEMS

[75] Inventors: Hans Baumgartner, Viersen; Eckehard Schmitz, Krefeld, both of Fed. Rep. of Germany

[73] Assignee: Pierburg GmbH & Co. KG, Neuss, Fed. Rep. of Germany

[21] Appl. No.: 312,829

[22] Filed: Oct. 19, 1981

[30] Foreign Application Priority Data

Oct. 21, 1980 [DE] Fed. Rep. of Germany ..... 3039613

[51] Int. Cl.[3] ..... F02M 3/06

[52] U.S. Cl. ..... 123/339; 123/585

[58] Field of Search ..... 123/339, 360, 585, 587, 123/588

[56] References Cited

U.S. PATENT DOCUMENTS

| | | | |
|---|---|---|---|
| 3,156,226 | 11/1964 | Linn | 123/585 |
| 3,661,131 | 5/1972 | Croft | 123/339 |
| 4,237,838 | 12/1980 | Kinugawa et al. | 123/339 X |
| 4,300,501 | 11/1981 | Suzuki | 123/360 X |
| 4,312,311 | 1/1982 | Iwata | 123/339 |

FOREIGN PATENT DOCUMENTS

| | | | |
|---|---|---|---|
| 714855 | 8/1965 | Canada | 123/585 |
| 2038041 | 7/1980 | United Kingdom | 123/339 |

*Primary Examiner*—Tony M. Argenbright

*Attorney, Agent, or Firm*—Toren, McGeady and Stanger

[57] ABSTRACT

In a reciprocating internal combustion engine of the spark ignition type the idling rotational speed of the engine is controlled by a system in which a secondary air flow through a passage bypassing the main air intake throttle valve (1) of the engine is controlled by a valve having a conical valve member (3) co-operating with a seat (2) to form a Laval nozzle at all open positions of the valve. The valve member (3) moves in response to the pressure difference across a diaphragm (9) separating two chambers (6) and (7). The chamber (7) communicates through a throttling element (8) with the pressure $P_s$ downstream of the throttle valve (1) and contains a spring (11) biassing the diaphragm (9) to open the valve (2, 3). The chamber (6) communicates through a throttling element (12) with the pressure $P_a$ upstream of the throttle valve (1) and also communicates through a more restricted throttling element (13) with the downstream pressure $P_s$. The communication of the chamber (6) to the pressure $P_a$ is also controlled by an electronic control valve (14) which operates and regulates a mark space ratio communicating the pressures $P_a$ and $P_s$ to the chamber (6) alternately and in response to the difference between the actual engine idling speed and a set-point idling speed.

17 Claims, 2 Drawing Figures

ENGINE IDLING SPEED CONTROL SYSTEMS

Figure 1:
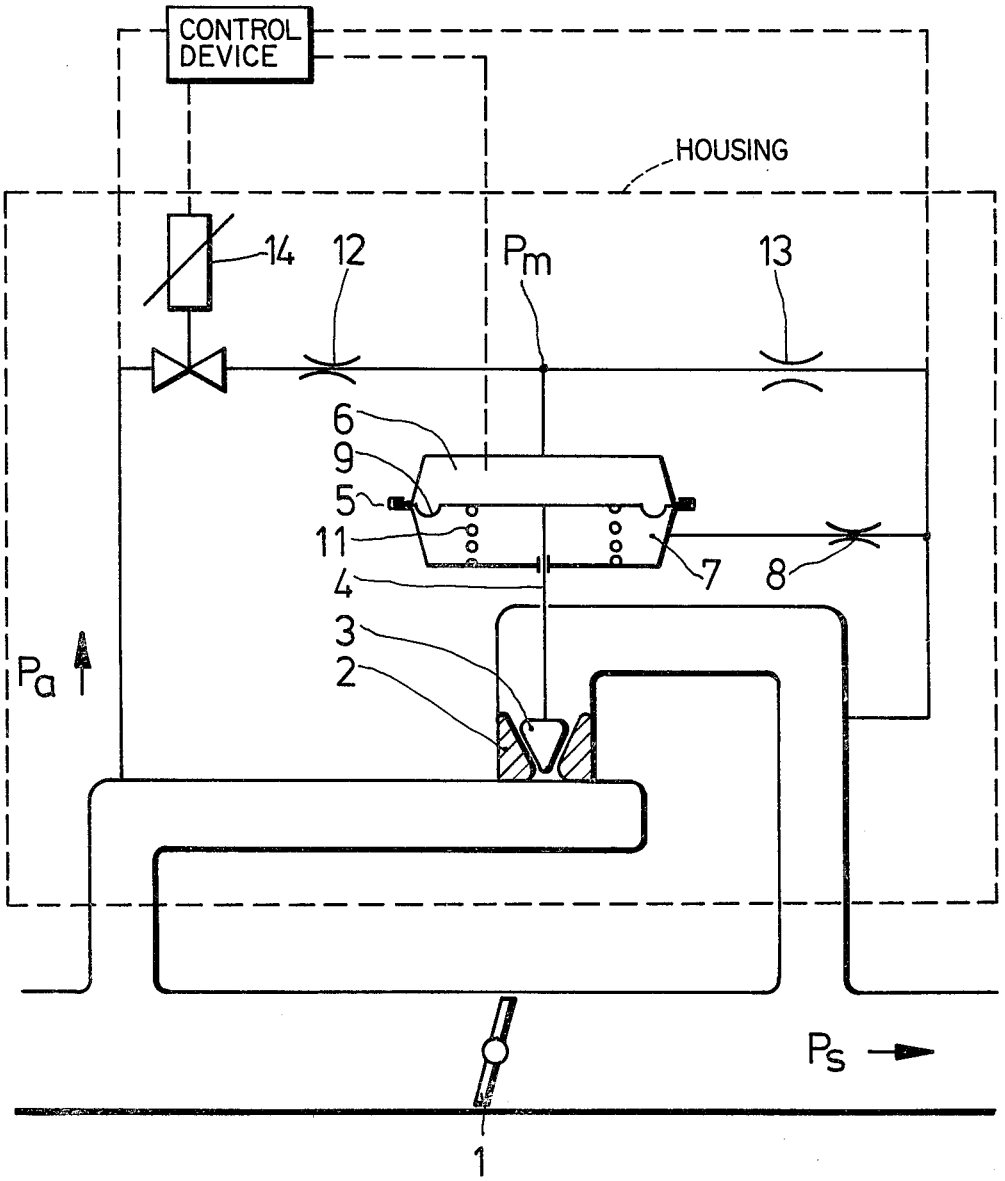

This invention relates to reciprocating internal combustion engines of the spark ignition type in which the idling rotational speed of the engine is controlled by controlling a valve which is located in a passage by-passing the throttle valve of the engine and which controls the flow of air through the by-pass passage to the engine. Engine idling speed control systems of this type are intended to balance the most varied influences to which the engine in the idling state can be subjected. They should ensure a substantially constant idling speed and prevent the engine from stalling under sudden load changes.

Systems are known, for example from DE-OS 29 27 749, in which the by-pass passage control valve is controlled as a function of the suction in the engine intake pipe so that when the engine is loaded when idling the opening cross-section of the valve is increased and, when the engine is relieved of load, it is decreased. The air or mixture flow rate thus supplied to the idling engine is automatically adjusted to suit the current load state of the engine.

Idling speed control systems are also known which are exclusively electronically controlled, deviations from a predetermined set-point idling speed being compensated by means of an electronic regulator which varies the air or mixture flow rate supplied to the engine via an electronic or electromagnetic actuating element.

The purely pneumatically controlled idling regulating systems are relatively simple in construction and also operate fairly favourably, but satisfactory operation is no longer assured if, for example due to aging or wear, increased actuating resistances occur or the vacuum in the intake pipe is modified, for example by a change of the ignition timing point or leakage of the engine inlet valves. Likewise, the influence of changes in ambient pressure, for example as a consequence of differing altitudes, and also changes in intake air temperatures and inlet states of the engine etc. are not balanced out. Electronically controlled idling regulating systems can operate as required, even under the above critical conditions, but the constructional complication necessary to achieve this is extremely high by comparison with the pneumatically controlled systems.

It has been proposed in U.K. Specification No. 2 012 997 A to provide an engine idling speed control system of the kind described in which the air flow control valve in the bypass passage is controlled pneumatically by an actuating element responsive to the pressure difference between one chamber which is loaded with the pressure from the region upstream of the throttle valve, and a second chamber which is loaded in the usual manner with the pressure downstream of the throttle valve but which is also arranged to communicate with ambient pressure when an electromagnetically switched valve is opened. The electromagnetic valve is always opened when the engine idling speed falls below a predetermined value or the load on the idling engine is increased by the switching-on of an energy consumer.

It has been found, however, that such a system can only partially fulfil the desired operating requirements, and in particular the regulating behaviour of the purely pneumatic part is not sufficiently favourable for this to be directly in a position to take over the greater part of the regulating functions, so that a comprehensive amount of electronic equipment is still necessary.

The aim of the present invention therefore is to provide an engine idling speed control system of the kind described, in which the simplicity of pneumatically controlled idling regulating systems is utilized to the greatest possible extent and electronic intervention of the control is carried out only when a purely pneumatic system can no longer achieve the desired result. The expenditure on electronic equipment will therefore be limited to what is absolutely necessary and furthermore all those functions that can be adequately fulfilled by the purely pneumatic part of the system will be carried out by that part, whereas the electronic regulating intervention will only be a superposition upon the pneumatic part.

To this end, according to the invention, a system for controlling the idling rotational speed of a reciprocating internal combustion engine of the spark ignition type and having a throttle valve for controlling the air intake of the engine comprises a passage by-passing the throttle valve to allow a secondary flow of air to the engine, and a combined pneumatically and electronically controlled valve in the by-pass passage for controlling the flow rate of the secondary air flow through the passage, the by-pass valve comprising a Laval nozzle, preferably formed at all open positions of the valve by a conical valve member and a co-operating valve seat in the passage.

The quality of the control system in accordance with the invention is an improvement compared with the known systems, particularly in so far as the critical variable conditions, which hitherto could only be mastered either inadequately or at high electronic expense, may be brought under control. The influence of ambient pressure changes in particular is one of these conditions.

The main advantages of the system in accordance with the invention stem from the flow properties of the Laval nozzle as the bypass valve. If the Laval nozzle is assumed to be initially so fixed in the bypass that a specific engine idling speed has become established, then any relief in the load on the engine results in an increase of speed and thus also in a reduction in the intake pipe pressure, but not in a greater secondary air flow rate since the pressure ratio is smaller than the critical pressure ratio of the Laval nozzle which is close to 1. Because the air flow does not rise, the increase in the rotational speed of the engine is not so large as that which would occur with conventional bypass valves, which bring about a greater air flow rate as the intake vacuum increases. The result of this is that changes in loading on the engine have a less severe effect and it offers the surprising advantage that a smaller and thus more easily managed regulating range is adequate. Due to the insignificant decrease of pressure at the Laval nozzle, the feed line of the mixture can be subject to a loss of feed pressure which had not been possible in the past, so that the line can be constructed with a small sectional area of flow, with the advantage that it requires little space and can be constructed in a simple manner, the small sectional area of flow resulting in a high flow velocity which counteracts any segregation of the combustible mixture. As already mentioned, another advantage lies in the altitude insensitivity of the system, since within certain limits fluctuations of the ambient pressure do not influence the air flow rate of the valve.

Figure 2:
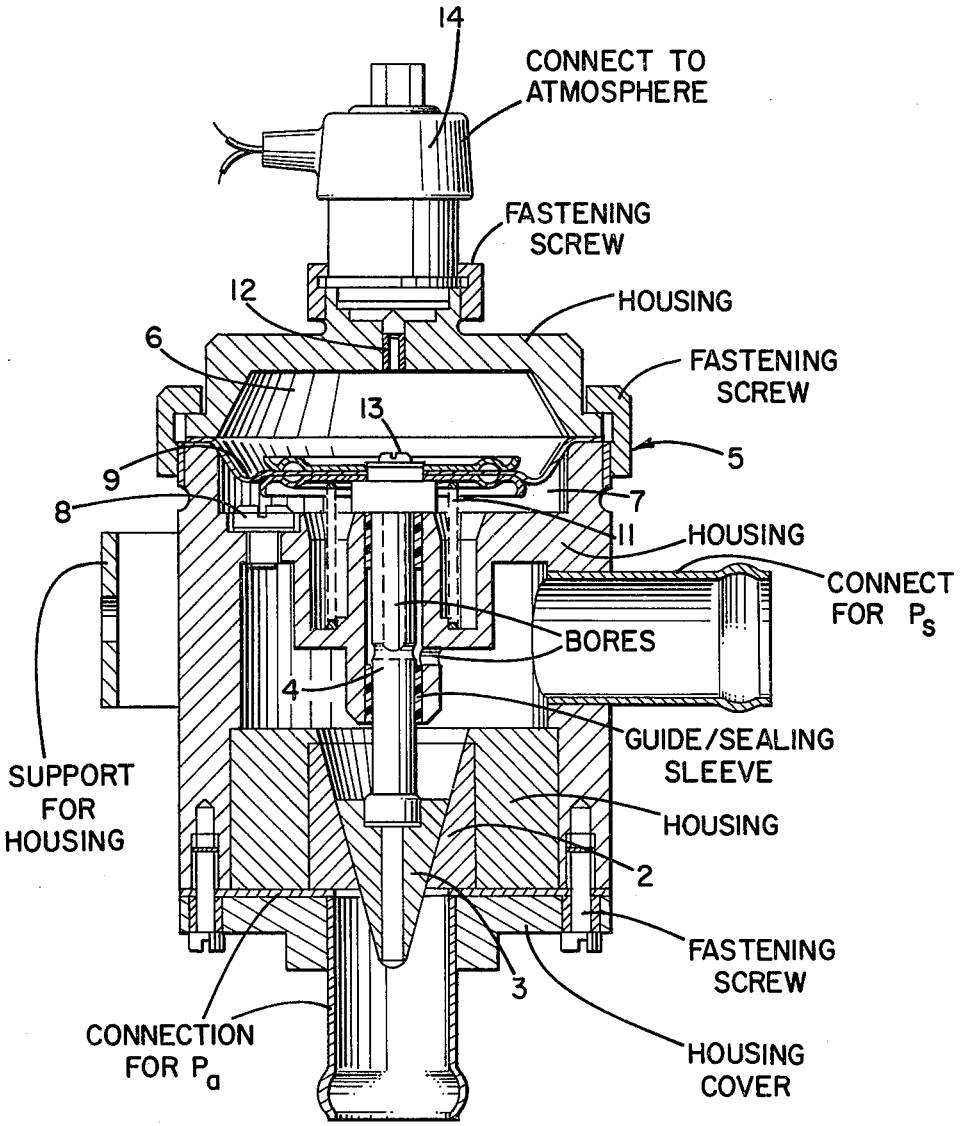

One example of the system in accordance with the invention, and various modifications thereof, will now be described with reference to the accompanying drawings wherein FIG. 1 is a schematic diagram illustrating the system and wherein FIG. 2 is a sectional view of apparatus embodying the invention.

In the drawings a throttle valve 1 is shown incorporated in an engine intake pipe. Upstream of the throttle valve 1 the intake pipe is normally at atmospheric pressure ($P_a$) or a pressure comparable therewith, and downstream the intake pipe is normally at the engine intake pressure ($P_s$) or a correspondingly comparable pressure. In a bypass passage bridging the throttle valve 1 there is a valve for controlling the flow of air through the bypass passage to the engine, the valve having a seating 2 and a conical valve member 3 which co-operates with the seat to constitute a Laval nozzle in every open position of the valve. The valve member 3 is moved by a thrust rod 4, and it is immaterial whether the valve member 3 is arranged to be pushed into the valve seat 2 at closure, or whether it is pulled into the seat. The thrust rod 4 is connected to the diaphragm 9 of a pneumatic actuator 5 which comprises an upper pressure chamber 6 separated from a lower pressure chamber 7 by the diaphragm 9. If the valve member 3 is pushed into the valve seating 2, as illustrated, the lower pressure chamber 7 is in communication with $P_s$ via a calibrated throttling element 8 so that a certain vacuum arises in the chamber 7. In order that this vacuum will not result in the diaphragm 9 travelling downwards so that the thrust rod 4 immediately closes the valve 2, 3, the diaphragm 9 is biased upwards by a spring 11. The equilibrium between the spring force and the vacuum is selected or is adjustable so that the correct opening state of the valve corresponding to the vacuum is assured on each occasion. In this case, the upper pressure chamber 6 is predominantly loaded with $P_a$ via a calibrated throttle element 12 which controls the gas flow rate through it when the diaphragm and hence the valve 2, 3 move to equilibrium. The arrangement of the chambers 6 and 7 is of course reversed if the valve member 3 is arranged to be pulled into the valve seating 2.

The result of the above arrangement is that when a reduction of $P_s$ occurs, the free cross-section of the valve 2, 3 is reduced, causing the air flow rate to decrease. As shown, the pressure chamber 6 which is loaded with $P_a$ is additionally connected with the region downstream of the throttle valve 1 by a duct containing a throttle element 13. $P_s$ therefore also acts upon the relevant pressure chamber 6, via the throttle element 13, so that a mixed pressure results in the chamber 6, whereas in the other chamber 7 preferably only $P_s$ occurs, or alternatively a second mixed pressure different from the mixed pressure in the chamber 6. For example, the pressure chamber 7 loaded with $P_s$ may be additionally in communication via a throttled connecting line with the other pressure chamber. Also the gas flow rate in at least one of the three connecting lines to the pressure chambers 6 and 7 is arranged to be differently drastically throttled or cyclically controlled by an electronically controlled valve, shown at 14 in the line communicating $P_a$ to the chamber 6.

In the example illustrated in the drawings the intake pipe pressure $P_s$, which occurs in the lower pressure chamber 7 via the throttling point 8, constitutes one working point of the regulating system. A mixed pressure $P_m$ composed of the intake pressure $P_s$ and the ambient pressure $P_a$ is present in the upper pressure chamber 6. $P_m$ is produced by certain gas flow rates passing via the electropneumatically open-and-closed cyclically controlled valve 14 and the succeeding Laval nozzle 12, which has an adjustable flow passage, into the pressure chamber 6, the throttling element 13 acting as a resistance element so that the flow rate to the region downstream of the throttle valve is less. This control pressure $P_m$ in the pressure chamber 6 and the pressure $P_s$ in the pressure chamber 7 together constitute a pressure difference which generates a force on the diaphragm 9 which finds equilibrium with the force of the spring 11 and therefore adjusts the valve member 3 of the Laval nozzle 2, 3 into a corresponding open position.

The pressure chamber 7 and the throttle element 8 are so designed that a change in the intake pipe pressure $P_s$ propagates into the pressure chamber 7 with a smaller delay than it takes to affect the pressure $P_m$ in the pressure chamber 6 via the throttle element 13. The result is that, in response to a decrease in $P_s$ (i.e. an increase in intake vacuum), movement of the valve cone 3 takes place initially in the closure direction and subsequently is partly restored in the opening direction. As a whole, this arrangement providing delayed recovery of an over-reaction exhibits the behaviour of a PD regulator, i.e., a proportional controller with a differentiating portion.

Furthermore, the pressure $P_m$ can be varied by the valve 14, in that cyclical control of this valve is carried out by a control device not illustrated in the drawings. This control device preferably behaves in the manner of an I regulator, i.e., a controller with a integral portion, and for this purpose, the device evaluates, for example, the difference between set-point and actual idling rotational speeds of the engine in such a manner that the rate at which the cyclic ratio is changed (e.g. in % per second) is in proportion to the pressure difference between the set-point and actual idling speeds. A load-relief of the engine is followed by increased vacuum in the intake pipe and increased actual engine idling speed. A continuing deviation of the actual engine speed in this direction can be regulated back by the valve cone 3 being further closed. For this purpose, the absolute pressure $P_m$ can be increased by increasing the keying ratio for the opening times of the valve 14.

The Laval nozzle 2, 3 in the bypass is so designed that it generates supersonic speeds even at low pressure differences. The same applies to the Laval nozzle 12. Thus fluctuations in the ambient pressure $P_a$ are possible without resulting changes in the mass flow rates through the Laval nozzle 12 and the valve 2,3. As a consequence the entire system is insensitive to differences in altitude.

In full-load operation of the engine, the suction pressure $P_s$ in the intake pipe is so low that the spring 11 can push the diaphragm 9 fully upwards and the volume of the pressure chamber 6 becomes very small. Advantageously, the diaphragm 9 in this position hugs the casing contour of the pressure chamber 6, so that if a sudden closure of the throttle valve 1 occurs (i.e. at high engine speed) the valve 2, 3 cannot suddenly close, because the volume of the pressure chamber 6 at the commencement of this operation is so small that even a slight downward movement of the diaphragm 9 creates the suction $P_m$ in the chamber 6 necessary for equilibrium to occur. This ensures that the valve 2, 3 closes in a delayed manner.

It has been found especially advantageous if the electronically superimposed control of $P_m$ is effected by subjecting the pressure chamber 6 alternately to the pressures $P_a$ and $P_s$ upstream and downstream respectively of the throttle valve 1, the cycle and the durations of the pressure applications preferably being electronically controlled. In a particularly simple and preferred arrangement, the pressure chamber 6 is subjected to the upstream pressure when the engine speed is too high and to the downstream pressure when the engine speed is too low.

It has been found especially advantageous to arrange the connecting ducts between the region upstream or downstream of the throttle valve 1 and the pressure chambers 6 and 7, including their throttling elements, through the thrust rod 4 connecting the valve member 3 to the diaphragm 9. For example, in the example illustrated, $P_s$ could act upon the pressure chambers 6 and 7 via a line inside the thrust rod 4 and correspondingly disposed throttle elements 8 and 13. If the valve member 3 is arranged to be pulled into the valve seating 2, then the corresponding connecting line for $P_a$ could pass through the thrust rod 4. All the other connecting lines and throttle elements, and also valves for the actuator 5, and the valve 2, 3 are preferably all integrated within a housing of the entire system, so that connections extending towards the outside are reduced to the inlet and outlet sides of the bypass and to the electricity supply for the electropneumatic valve or valves. The latter may be constructed as one single multi-way valve.

It will thus be understood that the system and its possible variations as described is relatively simple to manufacture and has a wide capacity for influencing the regulating of the engine idling speed in an extremely satisfactory manner.

It should be understood that as used herein the abbreviations P, I. and D refer to control behavior which acts in a proportional, integral as well as differentiating manner, respectively. Consequently, a PD controller is a proportional controller with a differentiating portion, a PID controller is a proportional controller with an integral and differentiating portion.

While a specific embodiment of the invention has been shown and described in detail to illustrate the application of the inventive principles, it will be understood that the invention may be embodied otherwise without departing from such principles.

We claim:

1. A system for controlling the idling rotational speed of a reciprocating internal combustion engine of the spark ignition type and having a throttle valve for controlling the air intake of the engine, said system comprising means defining a passage bypassing said throttle valve to allow a secondary flow of air to said engine, a valve disposed in said bypass passage for controlling the flow rate of the secondary air flow through said passage, and combined pneumatic and electronic control means for controlling the opening and closing of said bypass valve, said bypass valve comprising a Laval nozzle.

2. A system as claimed in claim 1, wherein said bypass valve includes a valve seat disposed in said bypass passage, and a conical valve member which is movable by said control means and which co-operates with said valve seat to form said Laval nozzle at all open positions of said valve.

3. A system as claimed in claim 2, wherein said control means includes a pneumatic actuator having first and second pressure chambers, first duct means communicating said first pressure chamber with the pressure downstream of said throttle valve through a calibrated throttling element in said first duct means, and second and third duct means communicating said second pressure chamber respectively with the pressure upstream and downstream of said throttle valve through further differently calibrated throttling elements in said second and third duct means, and means which moves said valve member in response to the pressure difference between said first and second pressure chambers.

4. A system as claimed in claim 3, wherein at least one of said throttling elements comprises a Laval nozzle.

5. A system as claimed in claim 4, wherein said throttling element in said second duct means communicating said second pressure chamber with said pressure upstream of said throttle valve comprises a Laval nozzle.

6. A system as claimed in claim 5, wherein said Laval nozzle of said throttling element is adjustable to provide different gas throughput rates.

7. A system as claimed in claim 3, wherein said throttling elements in said first and second duct means have different delay actions whereby the aperture of said bypass valve changes in a damped manner in response to a change in the pressure downstream of said throttle valve.

8. A system as claimed in claim 3, wherein said control means includes at least one electronically controlled valve which is connected upstream of one of said throttling elements and which is controlled so that, in conjunction with said throttling elements, proportional integral differentiating (PID) regulation of said idling rotational speed of said engine is performed when deviation occurs between a set-point idling speed and the actual idling speed of said engine.

9. A system as claimed in claim 8, wherein the purely pneumatically controlled components of said proportional integral differentiating (PID) regulating system provide the essential portion of its proportional differentiating (PD) behaviour.

10. A system as claimed in claim 3, wherein said control means includes cyclic means which is operative to communicate said second pressure chamber of said pneumatic actuator alternately with the pressures upstream and downstream of said throttle valve.

11. A system as claimed in claim 10, wherein said cyclic means includes electronic means for regulating the duration of the alternate pressure applications to said second pressure chamber.

12. A system as claimed in claim 10, wherein said second pressure chamber is subjected to the pressure upstream of said throttle valve when said engine speed is too high, and to the pressure downstream of said throttle valve when said engine speed is too low.

13. A system as claimed in claim 8, comprising electronically controlled valves which are combined in a multi-way valve.

14. A system as claimed in claim 3, wherein said pneumatic actuator includes a diaphragm separating said first and second pressure chambers and responsive to the pressure difference between said chambers, said diaphragm being adapted to fit substantially the form of one of said chambers when said bypass valve is fully open.

15. A system as claimed in claim 3, wherein said pneumatic actuator includes a diaphragm separating said first and second pressure chambers and responsive to the pressure difference between said chambers, and said means which moves said valve member comprises a thrust rod connected between said valve member and said diaphragm, said first and second duct means and their associated throttling elements being disposed in said thrust rod.

16. A system as claimed in claim 3, wherein said pneumatic actuator includes a diaphragm separating said first and second pressure chambers of said actuator and responsive to the pressure difference between said chambers, and said means which moves said valve member comprises a thrust rod connected between said valve member and said diaphragm, said third duct means and its associated throttling element being disposed in said thrust rod.

17. A system as claimed in claim 3, including a common housing for said bypass valve, said pneumatic actuator, and said first, second and third duct means and their associated throttling elements.

* * * * *